US007955692B2

(12) United States Patent
Gabara

(10) Patent No.: US 7,955,692 B2
(45) **Date of Patent: *Jun. 7, 2011**

(54) PROTECTIVE GARMENT COMPRISING FIBERS COMPRISING COPOLYMERS CONTAINING STRUCTURES DERIVED FROM A PLURALITY OF AMINE MONOMERS INCLUDING 4,4' DIAMINO DIPHENYL SULFONE

(75) Inventor: Vlodek Gabara, Richmond, VA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 48 days.

This patent is subject to a terminal disclaimer.

(21) Appl. No.: 12/229,419

(22) Filed: Aug. 22, 2008

(65) Prior Publication Data

US 2009/0053501 A1 Feb. 26, 2009

Related U.S. Application Data

(63) Continuation-in-part of application No. 11/894,939, filed on Aug. 22, 2007, now abandoned.

(51) Int. Cl.
*A41D 27/12* (2006.01)

(52) U.S. Cl. ..... 428/221; 528/337; 528/310; 428/359

(58) Field of Classification Search ..... 528/183, 528/185, 340, 348, 337; 428/221, 359
See application file for complete search history.

(56) References Cited

U.S. PATENT DOCUMENTS

| | | | | |
|---|---|---|---|---|
| 3,063,966 A | | 11/1962 | Morgan et al. | |
| 3,227,793 A | | 1/1966 | Cipriani | |
| 3,287,324 A | | 11/1966 | Sweeny | |
| 3,414,645 A | | 12/1968 | Morgan, Jr. | |
| 3,767,756 A | | 10/1973 | Blades | |
| 3,869,429 A | | 3/1975 | Blades | |
| 3,869,430 A | | 3/1975 | Blades | |
| 4,072,664 A | | 2/1978 | Konomi et al. | |
| 4,169,932 A | | 10/1979 | Sokolov et al. | |
| 5,174,790 A | | 12/1992 | Riggins et al. | |
| 5,468,537 A | | 11/1995 | Brown et al. | |
| 5,536,408 A | * | 7/1996 | Wagener et al. | 210/490 |
| 5,645,935 A | * | 7/1997 | Kemper et al. | 428/370 |
| 5,667,743 A | | 9/1997 | Tai et al. | |

FOREIGN PATENT DOCUMENTS

| | | |
|---|---|---|
| CN | 1389604 | 1/2003 |
| CN | 1631941 | 6/2005 |
| JP | 62-244404 | 10/1987 |
| JP | 01-299606 | 4/1989 |
| WO | WO 00/77283 | 12/2000 |

OTHER PUBLICATIONS

Jan Jager et al., A New Amorphous Heat-Resistant Aromatic Polyamide Fiber Prepared by Wet-Spinning; vol. 48, No. 11, 1945-1951 (1993); Journal of Applied Polymer Science, John Wiley and sons Inc., New York, US.

* cited by examiner

*Primary Examiner* — James Seidleck
*Assistant Examiner* — Gregory Listvoyb

(57) ABSTRACT

The invention concerns a protective garment comprising a fabric made from a flame-resistant yarn having a fiber, obtainable by spinning a copolymer from the polymerization solution, derived from a plurality of amine monomers, including 4,4'diaminodiphenyl sulfone amine monomer, and at least one acid monomer; having use in heat-resistant protective apparel.

8 Claims, No Drawings

PROTECTIVE GARMENT COMPRISING FIBERS COMPRISING COPOLYMERS CONTAINING STRUCTURES DERIVED FROM A PLURALITY OF AMINE MONOMERS INCLUDING 4,4' DIAMINO DIPHENYL SULFONE

RELATED APPLICATION

This application is a continuation in part of U.S. application Ser. No. 11/894,939 filed Aug. 22, 2007, now abandoned.

FIELD OF THE INVENTION

The invention concerns a fiber, obtainable by spinning a copolymer from the polymerization solution, derived from a plurality of amine monomers, including 4,4'diaminodiphenyl sulfone amine monomer, and at least one acid monomer; and yarns, fabrics and garments comprising this fiber, and methods of making the same. This fiber has use in heat-resistant protective apparel fabrics and garments.

BACKGROUND OF THE INVENTION

Chinese Patent Publication 1389604A to Wang et al. discloses a fiber known as polysulfonamide fiber (PSA) made by spinning a copolymer solution formed from a mixture of 50 to 95 weight percent 4,4'diaminodiphenyl sulfone and 5 to 50 weight percent 3,3'diaminodiphenyl sulfone copolymerized with equimolar amounts of terephthaloyl chloride in dimethylacetamide.

Chinese Patent Publication 1631941A to Chen et al. also discloses a method of preparing a PSA copolymer spinning solution formed from a mixture of 4,4'diaminodiphenyl sulfone and 3,3'diaminodiphenyl sulfone in a mass ratio of from 10:90 to 90:10 copolymerized with equimolar amounts of terephthaloyl chloride in dimethylacetamide.

In both these preparations, the copolymer chain has a high degree of para-orientation for high temperature structural stability. Unfortunately such systems tend to be insoluble in normal organic solvents, and therefore it is believed the addition of the meta-oriented 3,3'diaminodiphenyl sulfone provides enough disorder in this para-oriented system to allow the copolymer to be soluble in dimethylacetamide. Unfortunately, 3,3'diaminodiphenyl sulfone is expensive and is not widely available and therefore is undesirable as a copolymerizing species.

U.S. Pat. No. 4,169,932 to Sokolov et al. discloses preparation of poly(paraphenylene) terephthalamide (PPD-T) copolymers using tertiary amines to increase the rate of polycondensation. This patent discloses the PPD-T copolymer may be formed with terephthalic acid dichloride or a mixture of terephthalic acid dichloride (50-95 mole percent) and an aromatic acid dichloride of the diphenyl series (50-5 mole percent). This patent also discloses the PPD-T copolymer can be made by replacing 5 to 50 mole percent of the paraphenylene diamine (PPD) by another aromatic diamine such as 4,4'diaminodiphenyl sulfone, and provides an example of such a copolymer containing 95 mole percent paraphenylene diamine and 5 mole percent 4,4'diaminodiphenyl sulfone. While fibers made from the copolymers of Sokolov et al. are para-oriented, one of the benefits of PSA fiber is the high quantity of sulfone groups in the polymer chain that make the fiber exceptionally dyeable, something that would not be possible with the high PPD-content polymers of Sokolov.

Therefore, what is needed is a copolymer that is both soluble in normal organic solvents, has a high degree of para-oriented diamines for high temperature stability, and also has a high quantity of sulfone groups in the polymer chain.

SUMMARY OF THE INVENTION

In some embodiments, this invention relates to a fiber comprising a copolymer having a structure derived from the reaction of a plurality of amine monomers and an acid monomer, wherein the plurality of amine monomers comprises 4,4'diaminodiphenyl sulfone and at least one monomer present in an amount of up to 50 mole percent of the total amount of amine monomers and having the structure $$H_2N—Ar_1—NH_2$$

the 4,4'diaminodiphenyl sulfone being at least 25 mole percent of the total amount of amine monomers; and at least one acid monomer having a structure of $$Cl—CO—Ar_2—CO—Cl$$

the aromatic groups $Ar_1$ and $Ar_2$ each being a para-oriented benzene ring. In some other embodiments, this invention relates to a method of producing a fiber comprising the steps of a) forming a copolymer by reacting a plurality of amine monomers and one or more acid monomers, wherein the plurality of amine monomers comprises 4,4'diaminodiphenyl sulfone and at least one monomer present in an amount of up to 50 mole percent of the total amount of amine monomers and having the structure $$H_2N—Ar_1—NH_2$$

the 4,4'diaminodiphenyl sulfone being at least 25 mole percent of the total amount of amine monomers; and at least one acid monomer having a structure of $$Cl—CO—Ar_2—CO—Cl$$

the aromatic groups $Ar_1$ and $Ar_2$ each being a para-oriented benzene ring;

b) providing the copolymer in a solution suitable for spinning fibers; and c) spinning fibers from the copolymer solution.

DETAILED DESCRIPTION

The invention concerns a fiber, obtainable by spinning a copolymer from the polymerization solution, derived from 4,4'diaminodiphenyl sulfone amine monomer, at least one other amine monomer, and one or more acid monomers. In some preferred embodiments the fiber is a flame-resistant fiber having limiting oxygen index of 21 or greater. By "flame resistant" it is meant the spun staple yarn, or fabrics made from the yarn, will not support a flame in air. In preferred embodiments the fabrics have a limiting oxygen index (LOI) of about 26 and higher.

For purposes herein, the term "fiber" is defined as a relatively flexible, macroscopically homogeneous body having a high ratio of length to the width of the cross-sectional area perpendicular to that length. The fiber cross section can be any shape, but is typically round. Herein, the term "filament" or "continuous filament" is used interchangeably with the term "fiber."

As used herein, the term "staple fibers" refers to fibers that are cut to a desired length or are stretch broken, or fibers that occur naturally with or are made having a low ratio of length to the width of the cross-sectional area perpendicular to that length when compared with filaments. Man made staple fibers are cut or made to a length suitable for processing on cotton, woolen, or worsted yarn spinning equipment. The staple fibers can have (a) substantially uniform length, (b) variable or random length, or (c) subsets of the staple fibers have substantially uniform length and the staple fibers in the other subsets have different lengths, with the staple fibers in the subsets mixed together forming a substantially uniform distribution.

In some embodiments, suitable staple fibers have a length of about 0.25 centimeters (0.1 inches) to about 30 centimeters (12 inches). In some embodiments, the length of a staple fiber is from about 1 cm (0.39 in) to about 20 cm (8 in). In some preferred embodiments the staple fibers made by short staple processes have a staple fiber length of about 1 cm (0.39 in) to about 6 cm (2.4 in). The term continuous filament refers to a flexible fiber having relatively small-diameter and whose length is longer than those indicated for staple fibers.

By copolymer fibers having a structure derived from the amine monomer 4,4'diaminodiphenyl sulfone, it is meant the copolymer was made from a monomer generally having the structure:

$$NH_2—Ar—SO_2—Ar—NH_2$$

wherein Ar is any unsubstituted or substituted six-membered aromatic group of carbon atoms having para-oriented linkages with the $SO_2$ group. In one preferred embodiment Ar is an unsubstituted benzyl ring. The copolymer has mixture of amine monomers, of which at least 25 mole percent is 4,4'diaminodiphenyl sulfone to help provide para-orientation, and subsequently high temperature stability, to the copolymer. At least one of the other amine monomers present in the copolymer, has the general structure:

$$H_2N—Ar_1—NH_2$$

wherein $Ar_1$ is any unsubstituted or substituted para-oriented aromatic ring structure. One preferred para-oriented amine monomer is paraphenylene diamine. In some preferred embodiments up to 70 mole percent of the total plurality of amine monomers has para-oriented aromatic functionality. In this embodiment the other 30 mole percent of amine monomers present in the copolymer can have a meta-oriented aromatic ring structure, and one preferred amine monomer is metaphenylene diamine.

The amine monomers are copolymerized with at least one acid monomer in a compatible solvent to create a copolymer. The acid monomer have the structure $$Cl—CO—Ar_2—CO—Cl$$

wherein $Ar_2$ is any unsubstituted or substituted para-oriented aromatic ring structures. In some preferred embodiments $Ar_1$ and $Ar_2$ are both unsubstituted six-membered aromatic groups of carbon atoms. For example, $Ar_1$ and $Ar_2$ can be both benzene rings having para-oriented linkages. Examples of useful monomers include terephthaloyl chloride, isophthaloyl chloride, and the like, with terephthaloyl chloride being a preferred monomer.

In one preferred embodiment substantially all (95 mole percent or greater) of the amine monomers are derived from para-oriented structures. In some other embodiments, the plurality of amine monomers has 55 to 75 mole percent 4,4'diaminodiphenyl sulfone and 25 to 45 mole percent of another amine monomer containing the para-oriented aromatic group $Ar_1$, and further comprising a second acid monomer having meta-oriented aromatic ring structure present in 30 to 45 parts by weight, based on the total amount of acid monomers. In some embodiments, the second acid monomer comprises isophthaloyl chloride.

If more than one acid monomer is used, the combination of terephthaloyl chloride and isophthaloyl chloride is preferred. In some embodiments, the plurality of acid monomers includes 55 to 75 mole percent of acid monomers having para-oriented aromatic groups, such as terephthaloyl chloride, and 25 to 45 mole percent acid monomers having meta-oriented aromatic groups, such as isophthaloyl chloride.

It is believed that at least 15 percent of the total amount of aromatic monomers used to make the copolymer should contain monomers having meta-oriented functionality in order for the final copolymer to be soluble in the polymerization solvent and suitable for spinning fibers. By "total amount of aromatic monomers" is meant the total of all amine monomers and acid monomers added together. In other words, if the mixture of acid monomers contains only 15 mole percent of acid monomers having meta-oriented aromatic groups, at least 15 mole percent of the amine monomers must have meta-oriented aromatic groups, to make the total amount of aromatic monomers used to be 15 percent; based on a 1-to-1 amine-acid stoichiometry. In some embodiments 20 to 30 percent of the total amount of aromatic monomers used to make the copolymer contain monomers having meta-oriented functionality. In some embodiments, the maximum amount of monomers having para-oriented functionality is 85 percent of the total amount of aromatic monomers used to make the copolymer.

In a one embodiment, these fiber having a limiting oxygen index (LOI) of 21 or greater, meaning the fiber or fabrics made solely from the fiber will not support a flame in air. In some preferred embodiments the textile staple fiber has a LOI of at least 26 or greater.

In some embodiments the fiber has a break tenacity of at least 3 grams per denier (2.7 grams per dtex) or greater, and in some preferred embodiments the fiber has a break tenacity of at least 4 grams per denier (3.6 grams per dtex) or greater.

Fabrics can be made from the fibers, or from spun staple yarns or multifilament continuous yarns comprising the fibers, and such fabrics can include but are not limited to woven or knitted fabrics. Such fabrics are well known to those skilled in the art. By "woven" fabric is meant a fabric usually formed on a loom by interlacing warp or lengthwise yarns and filling or crosswise yarns with each other to generate any fabric weave, such as plain weave, crowfoot weave, basket weave, satin weave, twill weave, and the like. Plain and twill weaves are believed to be the most common weaves used in the trade and are preferred in many embodiments.

By "knitted" fabric is meant a fabric usually formed by interlooping yarn loops by the use of needles. In many instances, to make a knitted fabric spun staple yarn is fed to a knitting machine which converts the yarn to fabric. If desired, multiple ends or yarns can be supplied to the knitting machine either plied of unplied; that is, a bundle of yarns or a bundle of plied yarns can be co-fed to the knitting machine and knitted into a fabric, or directly into a article of apparel such as a glove, using conventional techniques. In some embodiments it is desirable to add functionality to the knitted fabric by co-feeding one or more other staple or continuous filament yarns with one or more spun staple yarns having the intimate blend of fibers. The tightness of the knit can be adjusted to meet any specific need. A very effective combination of properties for protective apparel has been found in for example, single jersey knit and terry knit patterns.

In some particularly useful embodiments, the fibers and yarns containing the fibers can be used to make flame-resistant garments. In some embodiments the garments can have essentially one layer of the protective fabric made from the spun staple yarn. Exemplary garments of this type include jumpsuits and coveralls for fire fighters or for military personnel. Such suits are typically used over the firefighters clothing and can be used to parachute into an area to fight a forest fire. Other garments can include pants, shirts, gloves, sleeves and the like that can be worn in situations such as chemical processing industries or industrial electrical/utility where an extreme thermal event might occur. In some preferred embodiments the fabrics have an arc resistance of at least 0.8 calories per square centimeter per ounce per square yard.

In other embodiments the fibers and yarns containing the fibers can be used in any layer of multilayer flame-resistant garments having a general construction such as disclosed in U.S. Pat. No. 5,468,537. Such garments generally have three layers or three types of fabric constructions, each layer or fabric construction performing a distinct function. There is an outer shell fabric that provides flame protection and serves as a primary defense from flames for the fire fighter. Adjacent the outer shell is a moisture barrier that is typically a liquid barrier but can be selected such that it allows moisture vapor to past through the barrier. Laminates of Gore-Tex® PTFE membrane or Neoprene® membranes on a fibrous nonwoven or woven meta-aramid scrim fabric are moisture barriers typically used in such constructions. Adjacent the moisture barrier is a thermal liner, which generally includes a batt of heat resistant fiber attached to an internal face cloth. The moisture barrier keeps the thermal liner dry and thermal liner protects the wearer from heat stress from the fire or heat threat being addressed by the wearer.

In another embodiment, this invention relates to a method of producing a fiber comprising the steps of a) forming a copolymer by reacting a plurality of amine monomers and one or more acid monomers, wherein the plurality of amine monomers comprises 4,4'diaminodiphenyl sulfone and a monomer having the structure $$H_2N—Ar_1—NH_2$$

the 4,4'diaminodiphenyl sulfone being at least 25 mole percent of the total amount of amine monomers; and at least one acid monomer having a structure of $$Cl—CO—Ar_2—CO—Cl$$

the aromatic group $Ar_1$ being the same or different from the aromatic group $Ar_2$;

b) providing the copolymer in a solution suitable for spinning fibers; and c) spinning fibers from the copolymer solution.

In one embodiment, the polymer and copolymer derived from a sulfone monomer can preferably be made via polycondensation of one or more types of diamine monomer with one or more types of chloride monomers in a dialkyl amide solvent such as N-methyl pyrrolidone, dimethyl acetamide, or mixtures thereof. In some embodiments of the polymerizations of this type an inorganic salt such as lithium chloride or calcium chloride is also present. If desired the polymer can be isolated by precipitation with non-solvent such as water, neutralized, washed, and dried. The general polymerization techniques disclosed in Chinese Patent Publications 1389604A to Wang et al. and 1631941A to Chen et al. can be applied to these solutions, and if desired the techniques disclosed in U.S. Pat. No. 4,169,932 to Sokolov et al. can also be followed. The polymer can also be made via interfacial polymerization which produces polymer powder directly that can then be dissolved in a solvent for fiber production.

The polymer or copolymer can be spun into fibers via solution spinning, using a solution of the polymer or copolymer in either the polymerization solvent or another solvent for the polymer or copolymer. Fiber spinning can be accomplished through a multi-hole spinneret by dry spinning, wet spinning, or dry-jet wet spinning (also known as air-gap spinning) to create a multi-filament yarn or tow as is known in the art. The fibers in the multi-filament yarn or tow after spinning can then be treated to neutralize, wash, dry, or heat treat the fibers as needed using conventional technique to make stable and useful fibers. Exemplary dry, wet, and dry-jet wet spinning processes are disclosed U.S. Pat. Nos. 3,063,966; 3,227,793; 3,287,324; 3,414,645; 3,869,430; 3,869,429; 3,767,756; and 5,667,743.

Continuous filament fibers and multifilament yarns of continuous filaments can be made by processes well known to those skilled in the art. For example, multifilament continuous filament yarns can be made by winding filament threadlines directly on a bobbin, with or without twist; or if needed, combining multiple filament threadlines to form higher denier yarns.

Alternatively, continuous filament can be converted into staple fiber by any number of ways known in the art, including processes that creel a number of bobbins of continuous filaments and concurrently cut the filaments to form cut staple fibers. For example, the staple fibers can be cut from continuous straight fibers using a rotary cutter or a guillotine cutter resulting in straight (i.e., non crimped) staple fiber, or additionally cut from crimped continuous fibers having a saw tooth shaped crimp along the length of the staple fiber, with a crimp (or repeating bend) frequency of preferably no more than 8 crimps per centimeter.

The staple fibers can also be formed by stretch breaking continuous fibers resulting in staple fibers with deformed sections that act as crimps. Stretch broken staple fibers can be made by breaking a tow or a bundle of continuous filaments during a stretch break operation having one or more break zones that are a prescribed distance creating a random variable mass of fibers having an average cut length controlled by break zone adjustment.

Generally these staple fibers are formed into bales; the staple fibers are then formed into spun staple yarns by processes that involve first opening the bales of staple fibers and then further processing the clumps of staple fibers in openers, blenders, and cards to form slivers of staple fibers. Generally, in the individual staple fibers are opened or separated to a degree that is normal in fiber processing to make a useful fabric, such that fiber knots or slubs and other major defects due to poor opening of the staple fibers are not present in an amount that detract from the final fabric quality. A carding machine is commonly used to separate, align, and deliver fibers into a continuous strand of loosely assembled fibers without substantial twist, commonly known as carded sliver. The carded sliver is processed into drawn sliver, typically by, but not limited to, a two-step drawing process.

Spun staple yarns are then formed from the drawn sliver using conventional techniques. These techniques include conventional cotton system, short-staple spinning processes, such as, for example, open-end spinning, ring-spinning, or higher speed air spinning techniques such as Murata air-jet spinning where air is used to twist the staple fibers into a yarn. The formation of spun yarns useful in fabrics can also be achieved by use of conventional woolen systems, long-staple or stretch-break spinning processes, such as, for example, worsted or semi-worsted ring-spinning.

Regardless of the processing system, ring-spinning is the generally preferred method for making the spun staple yarns using traditional long and short staple ring spinning processes that are well known in the art. For short staple, cotton system spinning fiber lengths from about 1.9 to 5.7 cm (0.75 in to 2.25 in) are typically used. For long staple, worsted or woolen system spinning, fibers up to about 16.5 cm (6.5 in) are typically used.

Spun staple yarns can also be made directly by stretch breaking using stretch-broken tow to top staple processes. The staple fibers in the yarns formed by traditional stretch break processes typically have length of up to about 18 cm (7 in) long. However spun staple yarns made by stretch breaking can also have staple fibers having maximum lengths of up to around 50 cm (20 in.) through processes as described for example in PCT Patent Application No. WO 0077283. Stretch broken staple fibers normally do not require crimp because the stretch-breaking process imparts a degree of crimp into the fiber.

TEST METHODS

Basis weight values were obtained according to FTMS 191A; 5041.

Arc Resistance Test. The arc resistance of fabrics is determined in accordance with ASTM F-1959-99 "Standard Test Method for Determining the Arc Thermal Performance Value of Materials for Clothing". The Arc Thermal Performance Value (ATPV) of each fabric, which is a measure of the amount of energy that a person wearing that fabric could be exposed to that would be equivalent to a 2nd degree burn from such exposure 50% of the time.

Grab Test. The grab resistance of fabrics (the break tensile strength) is determined in accordance with ASTM D-5034-95 "Standard Test Method for Breaking Strength and Elongation of Fabrics (Grab Test)".

Thermal Protection Performance (TPP) Test. The thermal protection performance of fabrics is determined in accordance with NFPA 2112 "Standard on Flame Resistant Garments for Protection of Industrial Personnel Against Flash Fire". The thermal protective performance relates to a fabric's ability to provide continuous and reliable protection to a wearer's skin beneath a fabric when the fabric is exposed to a direct flame or radiant heat.

Vertical Flame Test. The char length of fabrics is determined in accordance with ASTM D-6413-99 "Standard Test Method for Flame Resistance of Textiles (Vertical Method)".

Limiting Oxygen Index (LOI) is the minimum concentration of oxygen, expressed as a volume percent, in a mixture of oxygen and nitrogen that will just support the flaming combustion of a material initially at room temperature under the conditions of ASTM G125/D2863.

EXAMPLES

The invention is illustrated by, but is not intended to be limited by the following examples:

Example 1

The solvent dimethyl acetamide is purified and dried before use by distillation in the presence of $P_2O_5$. 200 grams of this solvent is placed in a flask equipped with a mechanical stirrer and a nitrogen inlet. 6.56 grams of 4,4'-diaminodiphenyl sulfone and 4.92 grams of paraphenylene diamine and 4.92 grams of metaphenylene diamine are dissolved in the solvent and the roughly 60/40/30 molar solution is cooled to 0° C. by water/ice bath. 20.3 grams of terephthaloyl chloride is added to the flask with agitation. The cooling bath is removed and the polymerization is continued for 30 minutes. At that point 7.4 grams of calcium hydroxide is added to neutralize HCl which is a byproduct of the polymerization. The resulting material is a viscous copolymer solution that is spun into fibers. The fibers are then processed into fabrics and garments.

Example 2

Example 1 is repeated except that the solvent dimethyl acetamide is replaced with N-methyl pyrrolidone without changes in the procedure. A viscous copolymer solution results that after degassing is used to form fibers that are subsequently processed into fabrics and garments.

Example 3

Example 1 is repeated except that the amine monomers are only 9.92 grams of 4,4'-diaminodiphenyl sulfone and 6.49 grams of grams of paraphenylene diamine to form a roughly 60/40 molar solution the single acid monomer terephthaloyl chloride is replaced by first forming a mixture of isophthaloyl chloride (ICL) and terephthaloyl chloride (TCL), the amount of ICL being 30 parts by weight and the TCL amount being 70 parts by weight based on the total weight of the acid monomer added in Example 1, and then adding this mixture to the flask with agitation. A viscous copolymer solution results that after degassing is used to form fibers that are subsequently processed into fabrics and garments.

Comparative Example A

Example 3 is repeated except that 20.3 grams of terephthaloyl chloride (TCL) is used as the sole acid monomer in place of a mixture of TCL and ICL. Upon addition of the TCL, polymer precipitates from the solution. The resulting polymerization mixture becomes hazy and is not useful for spinning fibers.

Example 4

Example 3 is repeated except that 45 parts by weight of ICL and 55 parts by weight TCL are used based on the total weight of the acid monomer added in that Example, and the acid chlorides are not first mixed but added separately to the flask with agitation. A viscous copolymer solution results that after degassing is used to form fibers that are subsequently processed into fabrics and garments.

Example 5

A thermally protective and durable fabric is prepared having in both the warp and fill ring spun yarns comprising a staple fiber of the process of Example 1. A sliver is prepared and processed by the conventional cotton system equipment and is then spun into a spun staple yarn having twist multiplier 4.0 and a single yarn size of about 21 tex (28 cotton count) using a ring spinning frame. Two single yarns are then plied on a plying machine to make a flame resistant two-ply warp yarn. Using a similar process and the same twist a 24 tex (24 cotton count) yarn is made for use in the fill. As before, two of these single yarns are plied to form a flame resistant two-ply fill yarn.

The yarns are then used as the warp and fill yarns and are woven into a fabric on a shuttle loom, making a greige fabric having a 2×1 twill weave and a construction of 26 ends×17 picks per cm (72 ends×52 picks per inch), and a basis weight of about 215 g/m$^2$ (6.5 oz/yd$^2$). The greige twill fabric is then scoured in hot water and is dried under low tension. The scoured fabric is then jet dyed using basic dye. The finished fabric has a basis weight of about 231 g/m$^2$ (7 oz/yd$^2$). The fabrics are used to make protective garments suitable for people who work near flames or high temperatures.

What is claimed:

1. A protective garment comprising a fabric made from a yarn, the yarn being flame-resistant and having fiber comprising a copolymer having a structure derived from the reaction of a plurality of amine monomers and an acid monomer, wherein i) the plurality of amine monomers comprises 55 to 75 mole percent 4,4'diaminodiphenyl sulfone and at least one monomer present in an amount of 25 to 45 mole percent of the total amount of amine monomers and having the structure $$H_2N—Ar_1—NH_2;$$

and ii) at least one first acid monomer having a structure of $$Cl—CO—Ar_2—CO—Cl$$

the aromatic groups $Ar_1$ and $Ar_2$ each being a para-oriented benzene ring, and a second acid monomer having meta-oriented aromatic ring structure present in 30 to 45 parts by weight, based on the total amount of acid monomers; and wherein the yarn is either a spun staple yarn or multifilament continuous yarn.

2. The protective garment of claim 1 wherein the amine monomer containing the aromatic group $Ar_1$ is paraphenylene diamine.

3. The protective garment of claim 1 wherein the first acid monomer is terephthaloyl chloride.

4. The protective garment of claim 1 wherein the second acid monomer comprises isophthaloyl chloride.

5. The protective garment of claim 1 wherein the flame-resistant yarn has a limiting oxygen index of 21 or greater.

6. The protective garment of claim 5 wherein the flame-resistant yarn has a limiting oxygen index of 26 or greater.

7. The protective garment of claim 5 wherein the flame-resistant yarn has a tenacity of 3 grams per denier (2.7 grams per dtex) or greater.

8. The protective garment of claim 7 wherein the flame-resistant yarn has a tenacity of 4 grams per denier (3.6 grams per dtex) or greater.

* * * * *